United States Patent [19]

Barzilai

[11] Patent Number: 4,949,564

[45] Date of Patent: Aug. 21, 1990

[54] PADLOCK WITH A HARD SHELL CASING FOR RECEIVING A CYLINDER LOCK UNIT

[75] Inventor: Israel Barzilai, Netanya, Israel

[73] Assignee: Nabob Ltd., Israel

[21] Appl. No.: 436,068

[22] Filed: Nov. 13, 1989

[51] Int. Cl.[5] ..... E05B 63/00

[52] U.S. Cl. ..... 70/417; 70/39

[58] Field of Search ..... 70/417, 39, 58 R, 58 A, 70/58 BC

[56] References Cited

U.S. PATENT DOCUMENTS 4,064,716 12/1977 Shwayder ..... 70/417

FOREIGN PATENT DOCUMENTS 0098986 1/1984 European Pat. Off. .

2740087 9/1978 Fed. Rep. of Germany .

OTHER PUBLICATIONS

Mul-T-Lock Padlocks (descriptive or advertising sheet).

*Primary Examiner*—Robert L. Wolfe

*Attorney, Agent, or Firm*—Ostrolenk, Faber, Gerb & Soffen

[57] ABSTRACT

A padlock consisting of an elongated lock casing, comprising an inner, solid member and an outer shell fitting over the same. The outer shell is made of a material protected against drilling or the like burglary attempts. The inner, solid member is made of a relatively soft material such as iron or other non-ferrous metal. A U-shaped shackle is adapted to be inserted into the casing and locked by a key-operated, cylinder-type locking device installed at one end of the lock casing.

8 Claims, 3 Drawing Sheets

PADLOCK WITH A HARD SHELL CASING FOR RECEIVING A CYLINDER LOCK UNIT

BACKGROUND OF THE INVENTION

The present invention relates to padlocks of the type comprising a padlock body or casing of elongated shape, and a detachable, U-shaped shackle with two arms adapted to become locked within the casing, using a cylinder-type locking device.

These padlocks are widely used, e.g. for locking shops, show-window protective grills, outdoor gates and the like.

The padlocks of the kind referred to are almost exclusively made of a hexagonal profiled bar usually cut from standard iron rods. The cut pieces are then machined in order to provide same with side openings for the shackle arms; with a cavity for accomodating the key-operated, cylinder-type locking device of any standard type, commercially available; with a blind bore for housing and rotatably supporting a lock rod which becomes engaged with suitable recesses formed in the shackle arms; and with an additional bore through which a screw-threaded bolt is adapted to be inserted for fastening the cylinder lock device within the lock casing.

In addition, after the various machining operations are completed, the lock body must undergo a heat treatment process to protect it against drilling, sawing and other such burglary attempts to which it might be exposed.

Finally the completed body must be polished in order to receive a metallic coating or electro-plating.

This processing of the lock body makes the product quite expensive on the one hand, and affects its suitability for mass production, on the other hand. Another deficiency of the conventional locks resides in that the various commercially available cylinder-locks are made so that the inner cylinder is free to rotate any number of turns. For adapting such locks to serve as padlock operating devices, special measures have to be taken to delimit the rotation of the key to a quarter of a revolution only. Usually this is attained by inserting an extra pin into the device casing.

Still in this context, in order to comply with security standards, the cylinder locking device must be provided with at least one—but usually more—anti-drill pins, to prevent tampering with the cylinder mechanism of the lock.

It is thus the general object of the invention to provide a method of manufacturing padlocks of the type referred to, consisting of fewer production stages—and therefore being less costly—without, however, affecting their security level relative to the conventional padlocks.

It is a further object of the invention to provide padlocks composed essentially of an inner member made of relatively soft and easy-to-process material, such as cast iron or nonferrous metals, on the one hand, and a sheath or cover of burglary-protected material such as hardened steel.

It is a still further object of the invention to provide such sheath being made of standard steel pipe length that need no processing other than hardening heat treatment.

It is a still further object of the invention to save the extra manufacturing costs of the rotation limiting means, on the one hand, and the safety pins, on the other hand, with which the cylinder lock device must be equipped before it can be used for the purpose in question.

In addition, it has been found that other advantages are attained regarding simplicity of manufacture and assembly as will be explained in detail below.

SUMMARY OF THE INVENTION

According to the invention there is provided a padlock consisting of an enlongated lock casing and a U-shaped shackle adapted to be inserted into the casing. The shackle is locked by a key operated, cylinder-type locking device installed at one end of the lock casing. The padlock comprises an inner, solid member made of a material which is substantially unprotected against drilling or the like burglary attempts enclosed within a protected outer shell.

The shell may be tubular, and at least one cup-shaped end cover is provided, fitting over an end portion of the inner member so that it is at least partly covered by a corresponding end portion of the shell.

Preferably a pair of such ends covers are provided for each end of the inner padlock member.

Snap-action fastening means are preferably used to lock the end covers as well as the shell proper, provided at the two opposite ends and at the center of the padlock casing, respectively.

The inner member, including most of its cavities, recesses etc., may be formed by a die-casting process.

These and further constructional details of the invention will become more clearly understood in the light of the ensuing description of a preferred embodiment thereof, given by way of example only, with reference to the accompanying drawings.

DETAILED DESCRIPTION OF THE PREFERRED EMBODIMENT

Figure 1:
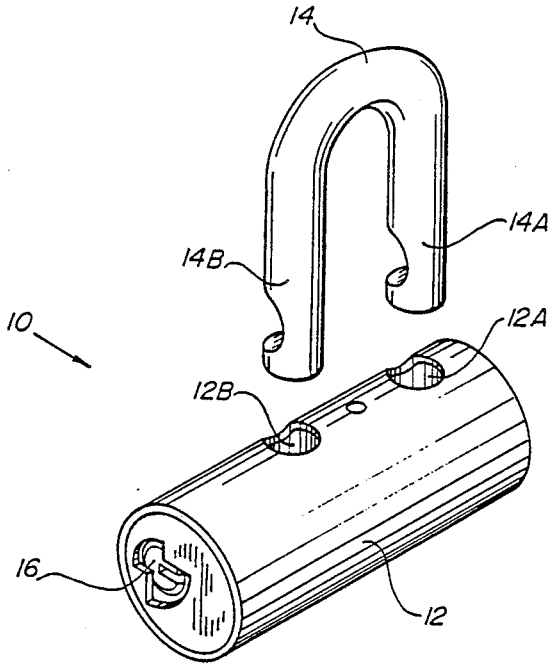
FIG. 1 is a general, three-dimensional view of the padlock and associated shackle or yoke member.

As shown in FIG. 1, the padlock generally denoted 10 consists, as usual, of a padlock body or casing 12 and shackle 14. The shackle arms 14A and 14B are adapted to be received within suitable bores 12A and 12B formed in the casing 12. A conventional locking device 16 is accomodated within the casing 12, again in conformity with the conventional design of the padlocks.

However, and as most clearly shown in FIG. 2, rather than have the casing 12 made of a solid metal bar section, the padlock according to the invention consists of the separable parts and components described below.

An inner body member 20, which may be provided with one or more cut-outs such as that marked 22 for decreasing the overall weight of the padlock, preferably cast of iron or a nonferrous metal.

While the member is shown to be cylindrical, other profiled shapes may equally be used, although the cylindrical shape proves to be superior in that it does not readily allow the clamping of the padlock body by a vice when a burglar tries to tear off the shackle 14 from the body 12.

Figure 4:
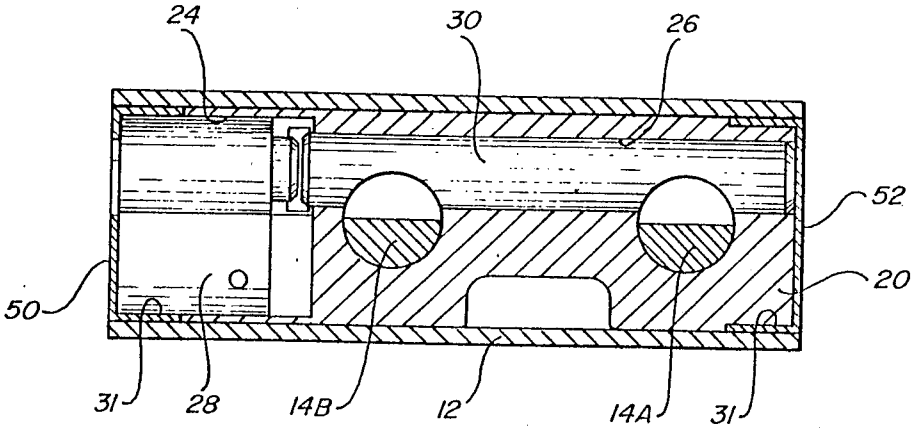
FIG. 4 is a section taken along line IV—IV of FIG. 3.
Figure 3:
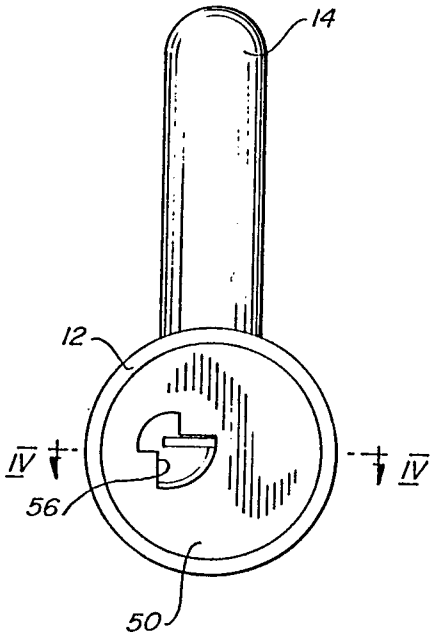
FIG. 3 is a side view of the padlock in its assembled position.

The inner body member 20 is further processed—either by machining or during its casting—by an inner cavity 24 extended by a through-going bore 26 (FIG. 4) (rather than a drilled, blind bore as in the conventional designs) for housing, the standard cylinder lock device 28 and operating rod 30, respectively.

At the opposite end portions of the body 20 shoulders are formed providing shallow circumferential recesses 31 as shown.

At the outside of the body 20, besides the shackle-receiving bores 12A and 12B, three blind bores 32, 34 and 36 are provided for accomodating snap-action fastening means, which may take the form of coil springs 38, 40 and 42 and lock detents in the form of pins 44, 46 and 48, whose function will be further described below. Preferably the same arrangement of bores, springs and pins will be provided at a location opposite the bores 32 and 36.

Now there are provided a front cup-shaped end cover 50 and a rear cup-shaped cover 52. Cover 50 is provided with an opening 54 designed to receive the snap-action fastener pin 44, and cover 52 has opening 58 for the pin 48. Similar openings may be provided at the opposite side of each of the covers, should a snap-action fastener be provided at both diametrical sides of the member 20.

The inner diameters of the covers 50 and 52 are such that they fit snuggly over the circumferential recesses 31 of the body 20.

Furthermore, a profiled slot 56 is made in the front cover member 50, through which the operating key of the cylinder 28 is adapted to pass. The profile of the slot 56 is so designed as to limit the amount of rotation to 90 degrees, as required for the proper operation of the padlock.

It is essential according to the invention that the pipe section 12 as well as the cups 50 and 52 be made of steel which allows hardening by suitable thermal treatment. The cover 12 may be cut from standard steel pipe readily available on the market, whereas the members 50 and 52 may be punched of any suitable steel sheet metal and then hardened and coated by Nickel or Chromium, to make the product appealing to the customer. As already mentioned, the finish, or surface smoothness of pipes is much better than that of standard hexagonal rods, rendering the former more readily applicable for the electro-plating process.

Figure 2:
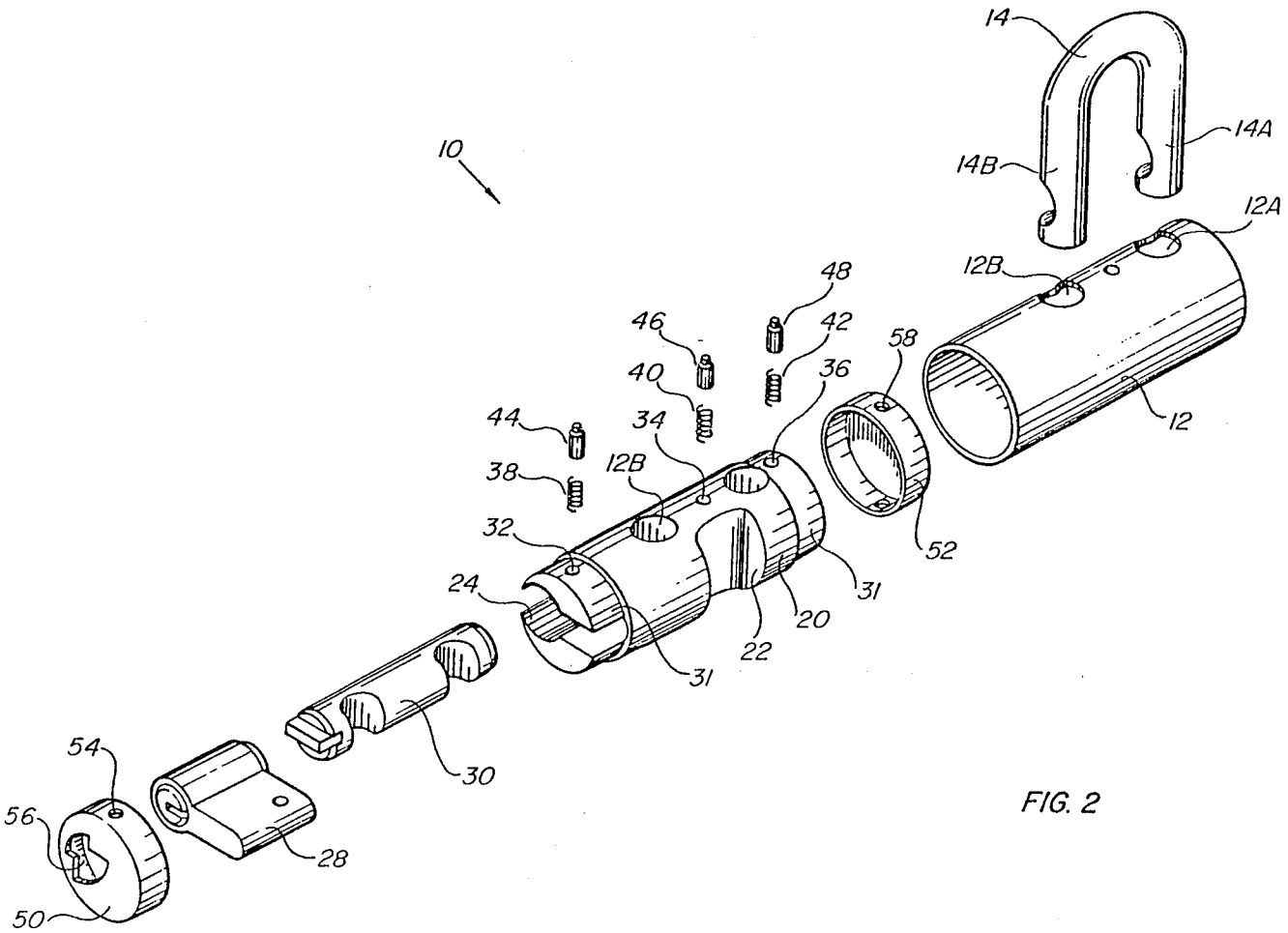
FIG. 2 is an exploded, three-dimensional view of the padlock of FIG. 1.

The assembly of the parts shown in FIG. 2 is in the following manner: First the rear end cover 52 is seated and snapped into place by its fastening pin(s) 48. The operator rod 30 and the cylinder 28 are inserted and become held in their operative engaging position by the cover 50 fastened to the front end portion of the body 20.

It will be readily appreciated, according to another unique feature of the invention, that, since the cylinder locking device 28 is completely concealed within the body 20, it need not be provided with extra safety means such as anti-drill pins, as prescribed by the relevant standards.

The completed body assembly is then fitted snuggly into the shell 12, which is fixed into position by the snap pin 46.

No further means are required for prevention of the dismantling of the shell 12, e.g. during a burglary attempt, since the shackle arms 14 provide most safe positioning means against such disassembly, i.e. in the locked position of the padlock.

It will be further noted that the pins 44 and 48—with or without their counterparts at the opposite side of the body 20 —are inaccessible from outside, as they are covered by the shell 12 and need not be further protected. In fact, all the internal components of the padlock become nested within the steel sheath, preferably of cylindrical shape, making it impossible to tamper with by ordinary burglar tools.

Still another advantage gained by the proposed construction of the padlock is the simple and easy exchange of the cylinder devices 28 (in case of malfunction or key loss) by partly uncovering the front cover member 50, releasing same from its seat and replacing the cylinder with a new one. Furthermore, a great variety of cylinder devices, e.g. of various models or commercial sources can be used by just putting them into the cavity 24 which, as known, is of standard outer measurements and configuration—but of various lengths. If necessary, distant pieces may be added to compensate for devices of different lengths, as may be found on the market. In any event, the disadvantageous use of a special assembly screw is no longer required, which improves the lock both in respect of safety, and of reducing manufactuing costs. All the above mentioned features are readily attained by the structure proposed according to the invention, not, however, at the expense of the security-level offered by the novel device; on the contrary, the padlocks according to the invention may be readily manufactured of various suitable sizes in terms of shell diameter and wall thickness, and of the diameter of the shackle 14.

Those skilled in the art will readily appreciate that numerous changes, modifications and variations may be applied to the invention as hereinbefore exemplified without departing from its scope as defined in and by the appended claims.

What is claimed is:

1. A padlock comprising:

an elongated lock casing, the casing having bores extending in from its periphery, a U-shaped shackle adapted to be inserted into the bores in the casing, a key-operated, cylinder-type locking device installed at one end of the lock casing for locking the shackles in the casing bores;

the casing comprising:

an inner solid member made of a material which is substantially unprotected against drilling or the like burglary attempts; the inner member having opposite end portions;

an outer tubular shell fitted over the inner member and made of a material protected against drilling or the like burglary attempts; the outer shell also having opposite end portions;

a respective cup shaded end cover being fitted over each end portion of the inner member, the end cover being at least partly covered by a corresponding end portion of the shell;

recesses formed at the inner member end portions, and the end covers being received in the respective recesses, each inner member end portion being provided with releasable fastening means for holding its respective end cover;

each cover has a circumferential rim portion with an opening formed in it, each cover fastening means comprise a spring-urged detent adapted to project, in its fastening position, into the opening formed in the circumferential rim portion of the respective end cover, so that the detent becomes protectively covered by the shell.

2. The padlock as claimed in claim 1 comprising releasable shell fastening means fastening the shell to the inner member.

3. The padlock as claimed in claim 2 wherein an opening is formed in a central portion of the shell, the shell fastening means comprise a spring-urged detent adapted to project, in its fastening position, into the opening formed in the central portion of the shell.

4. The padlock as claimed in claim 3 wherein one of the end covers is mounted at the end of the casing accommodating the cylinder locking device and the one end cover is formed with a slot profiled so as to limit the angular rotation of a key in the locking device.

5. The padlock as claimed in claim 4 wherein the inner member is cylindrical.

6. The padlock as claimed in claim 5 wherein the shell consists of a length of pipe.

7. The padlock as claimed in claim 6 wherein the inner member is made of cast metal, and the shell and end covers are made of hardened steel.

8. The padlock as claimed in claim 7 wherein the cylinder locking device is freely seated within a cavity formed at the one end of the inner member.

* * * * *